US006158096A

United States Patent [19]

Bar

[11] Patent Number: 6,158,096

[45] Date of Patent: Dec. 12, 2000

[54] SHOE TONGUE POSITIONER

[76] Inventor: Oren Bar, P.O. Box 62983, Lafayette, La. 70596-2983

[21] Appl. No.: 09/256,874

[22] Filed: Feb. 24, 1999

[51] Int. Cl.[7] ..... A43C 11/00; A43B 11/00

[52] U.S. Cl. ..... 24/712.9; 24/114.9; 24/712.6; 24/712.1; 24/713.6

[58] Field of Search ..... 24/712.9, 713.6, 24/712.2, 712.6, 712.1, 712

[56] References Cited

U.S. PATENT DOCUMENTS

| | | | |
|---|---|---|---|
| 657,606 | 9/1900 | Lee | 24/712.6 |
| 878,129 | 2/1908 | Downer | 24/712.6 |
| 2,324,962 | 7/1943 | Storey | 24/712.2 |
| 3,715,781 | 2/1973 | Salvatori | 24/114.9 |
| 3,787,935 | 1/1974 | Kapitan | 24/114.9 |
| 4,553,293 | 11/1985 | Blum | 24/712.2 |
| 4,780,936 | 11/1988 | Brecher | 24/712.2 |
| 4,897,947 | 2/1990 | Kass-Pious | 36/136 |
| 5,214,826 | 6/1993 | Fortune | 24/712 |
| 5,333,398 | 8/1994 | Ceo | 24/712.9 |
| 5,402,589 | 4/1995 | Lubrani et al. | 24/712.2 |
| 5,564,203 | 10/1996 | Morris | 36/50.1 |

FOREIGN PATENT DOCUMENTS

| | | | |
|---|---|---|---|
| 0328979 | 11/1920 | Germany | 24/712.1 |
| 0635893 | 9/1936 | Germany | 24/712.6 |
| 0162385 | 4/1921 | United Kingdom | 24/713.6 |
| 0454355 | 9/1936 | United Kingdom | 24/712.9 |

*Primary Examiner*—Victor N. Sakran
*Attorney, Agent, or Firm*—Ted M. Anthony

[57] ABSTRACT

An assembly for use in connection with lace-type shoes to secure the tongues of such shoes in a stationary position, and to provide a base or foundation for mounting of ornamental displays on the upper surface of shoe tongues. A rigid upper member having one or more bores is attached to the upper surface of a shoe tongue using tacks which are pushed through the shoe tongue and received within such bores. Shoelaces are wrapped around the rigid upper member and thereafter secured. The rigid upper member provides a base or foundation for attaching easily interchangeable ornamental designs.

16 Claims, 5 Drawing Sheets

SHOE TONGUE POSITIONER

CROSS REFERENCES TO RELATED APPLICATIONS (Not Applicable)

STATEMENTS AS TO RIGHTS TO INVENTIONS MADE UNDER FEDERALLY-SPONSORED RESEARCH AND DEVELOPMENT (Not Applicable)

BACKGROUND OF THE INVENTION

1. Field of the Invention.

The present invention relates to footwear and the like. More particularly, the present invention relates to a shoe tongue positioner which can be engaged by a shoelace of a standard lace-type shoe to secure a shoe tongue in place, and which further provides a platform for mounting of an ornamental design, product logo or decorative emblem.

2. Description of the Related Art.

A well known problem with existing lace-type shoes is slippage or movement of a shoe tongue from its intended position over the upper-middle portion of a shoe wearer's foot. This problem is especially prevalent with athletic shoes, wherein rapid or repeated foot movement, particularly in lateral directions, can cause a shoe tongue to creep toward the front of the shoe or, more commonly, to slip to either side of a shoe wearer's foot. When such slippage or movement of a shoe tongue occurs, the wearer can experience significant discomfort. Further, such slippage or movement of the shoe tongue can detract from the appearance and aesthetic quality of the shoe.

For some time, shoe manufacturers have provided a loop on the upper surface of shoe tongues in an attempt to alleviate this problem. Shoelaces are generally passed through such a tongue loop as part of the normal lacing pattern. When the shoelaces are tightened and tied, the shoe tongue is intended to be secured in place. However, while such a loop may prevent a shoe tongue from creeping forward toward the toe of the shoe, such a loop generally will not prevent all lateral movement of the tongue. Thus, even with such existing tongue loops, shoe tongues can still exhibit a tendency to slip to either side of a shoe.

It is also popular, especially among children and younger people, to wear and display product logos, insignias and the like on articles of clothing. In addition to the aforementioned attributes, the present invention also provides a platform for the attachment of an ornamental design, product logo, insignia or other decorative emblem over the lace portion of a standard lace-type shoe.

The prior art contains numerous arrangements which have been devised for use in combination with lace-type shoes. Despite these efforts, a need still remains an inexpensive and easily useable device which will hold a shoe tongue in a stationary position, while providing a platform for the display of an ornamental design, product logo, insignia or other decorative emblem on a shoe.

U.S. Pat. No. 5,333,398 to Seo discloses a lace fastening device which enables a standard lace-type shoe to be secured without the need for tying a bow knot. The '398 patent discloses a cleat, positioned over a shoe tongue, through which a shoelace is threaded. The shoelace is wrapped around the cleat in order to hold the lace and secure the shoe on the wearer's foot. Unlike the present invention, the lace fastening device of the '398 patent will not permit the lace to be tied in a standard bow knot. Further, the cleat described in the '398 patent is significantly more bulky and cumbersome than the invention disclosed herein, and requires use of a specifically designed finger pull to secure the ends of the shoelace.

U.S. Pat. No. 5,402,589 to Lubrani, et al, discloses an apparatus for securing a shoelace which is coupleable to a shoe tongue. The device disclosed in the '589 patent utilizes opposing jaw members which secure a shoelace during intermediate stages in the tying of a bow knot. As with the apparatus disclosed in the '398 patent, the device described in the '589 is more bulky and cumbersome than the present invention disclosed herein.

U.S. Pat. No. 4,597,198 to Schweitzer discloses an ornamental attachment for mounting on lace-type shoes. However, the apparatus disclosed in the '198 patent will not secure the tongue of a lace-type shoe in a stationary position. Further, the apparatus disclosed in the '198 patent is not as versatile as the present invention, because it will not permit, fast and easy changing of an ornamental design.

Other prior art references which involve or otherwise relate to attachments for lace-type footwear include: U.S. Pat. No. 5,564,203 to Morris; U.S. Pat. No. 5,535,531 to Karabed, et al; U.S. Pat. No. 4,897,947 to Kass-Pious; U.S. Pat. No. 4,545,138 to Blum; and U.S. Pat. No. 4,507,882 to Harrell. None of these patents disclose a durable and inexpensive footwear attachment which can be engaged by a shoelace of a standard lace-type shoe to secure a shoe tongue in place, and which further provides a platform for mounting and display of an ornamental design, product logo, insignia or decorative emblem.

It is an object of the invention to provide a novel attachment for engagement with the shoelace of a standard lace-type shoe to secure the tongue of said shoe in a generally stationary position.

It is a further object of the invention to provide a platform for the mounting and display of an ornamental design, product logo, insignia or other decorative emblem over the lace portion of a standard lace-type shoe.

It is a further object of the invention to provide a novel attachment for engagement with the shoelace of a standard lace-type shoe to secure the tongue of said shoe in a generally stationary position, as well as provide a platform for the mounting and display of an ornamental design, product logo, insignia or other decorative emblem over the lace portion of a standard lace-type shoe, which will not interfere with the normal tying and untying of the lace of said shoe, and which will permit easy removal or interchanging of such design, logo, insignia or emblem.

It is a further object of the invention to provide such an attachment which is durable, can be readily and inexpensively fabricated, and which can be manufactured as part of a new shoe, or used in connection with an existing shoe.

Other objects, features and advantages of the present invention will become apparent upon reading the specification in connection with the accompanying drawing figures.

SUMMARY OF THE INVENTION

The present invention, in its preferred form, generally comprises a rigid upright central member which is affixed to the tongue of a standard lace-type shoe near the top of said shoe tongue, and which extends outward from the upper surface of said shoe tongue. A shoelace is threaded through the eyelets of the shoe in standard fashion. Once the shoe tongue positioner of the present invention is reached, opposing loops of the shoelace are wrapped around said upright central member, and the lacing pattern is then resumed. The shoelace is then tightened, and the shoe is secured on the wearer's foot by means such as a standard bow knot.

By looping the shoelace around said upright central member in opposite directions, opposing forces are imparted on said upright central member and, accordingly, on the attached shoe tongue as well. Such opposing forces act to secure the tongue in a stationary position, thereby preventing said tongue from slipping laterally toward either side of the wearer's foot. Similarly, the loops of the shoelace also prevent the shoe tongue from creeping or bunching near the toe of the shoe.

It is envisioned that a shoe can be manufactured with the shoe tongue is positioner of the present invention intregally attached to a shoe tongue. Alternatively, the shoe tongue positioner of the present invention can be added to a standard lace-type shoe tongue.

In instances where it is added to an existing shoe, the shoe tongue positioner of the present invention is comprised of an upper body having a rigid upright central member as well as means for affixing or attaching said upper body to the upper surface of a shoe tongue. In the preferred embodiment, said means for affixing or attaching said body to said shoe tongue is comprised of one or more tacks which penetrate through said shoe tongue and anchor within said upper body. Further, in the preferred embodiment, a generally flat base plate can be used in connection with said tacks and positioned against the lower surface of the tongue to prevent said tacks from pulling completely through said shoe tongue.

The upright central member, which extends above the shoelaces of the subject footwear, further provides a surface or platform for mounting or display of an ornamental emblem, company logo, insignia or other design. Additionally, said upright central member may include means for attaching an ornamental design or emblem to said central member. In its preferred embodiment, said attachment means is comprised of a snap on both sides of the upright central member. However, it is envisioned that some other attachment means such as velcro or the like could be used for this purpose, provided said ornamental emblem, company logo, insignia or other design can be quickly and easily removed and replaced. In this manner, said emblems, logos, insignias or designs can be quickly and easily interchanged.

DESCRIPTION OF PREFERRED EMBODIMENT

Figure 1:
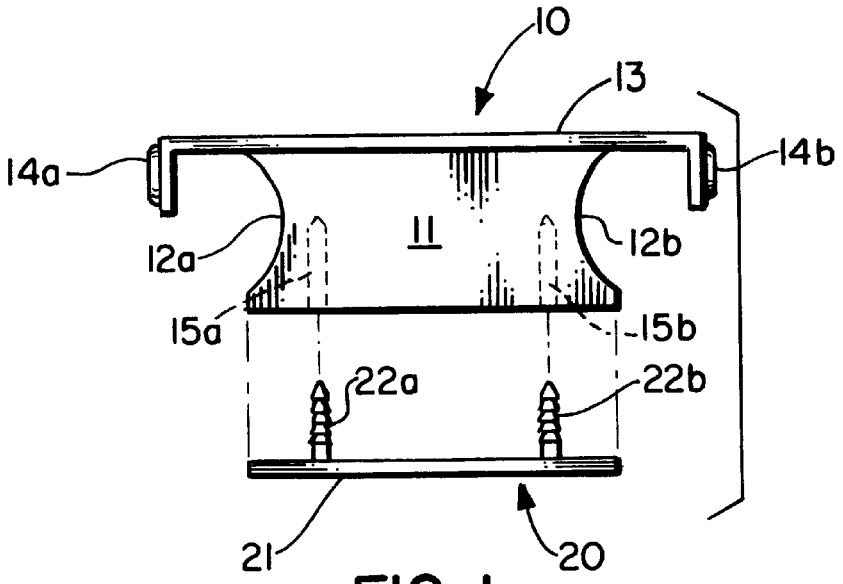
FIG. 1 is a side view of the shoe tongue positioner of the present invention.
Figure 2:
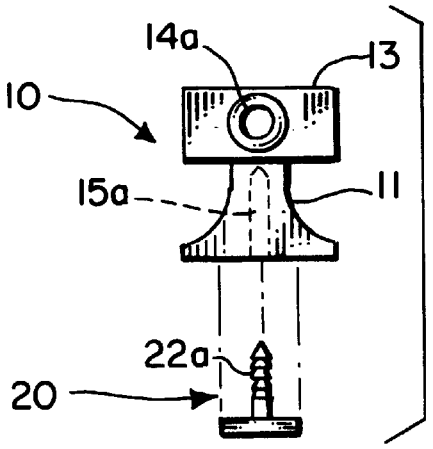
FIG. 2 is an end view of the shoe tongue positioner of the present invention.

Referring generally to FIG. 1 and FIG. 2, the shoe tongue positioner of the present invention comprises upper body 10 and lower body 20. Upper body 10 has rigid upright central member 11, having lateral sides 12*a* and 12*b*. In the preferred embodiment, lateral sides 12*a* and 12*b* exhibit an inwardly concave shape. Upper body 10 further comprises upper surface 13, as well as lateral attachment snaps 14*a* and 14*b*. Bores 15*a* and 15*b* extend from the base of upper body 10 into said rigid upright central member 11.

Lower body 20 comprises generally flat base member 21, as well as fastening tacks 22*a* and 22*b*. Fastening tacks 22*a* and 22*b* can be received within bores 15*a* and 15*b*, respectively, of upper body 10. Generally flat base member 21, which can be constructed of any number of materials, should be of minimal thickness, yet should be sufficient to support tacks 22*a* and 22*b*. Although it is possible that a single tack can be used in connection with the present invention, it is preferable to utilize at least two tacks to minimize pivoting and/or swiveling of upper body 10.

Figure 3:
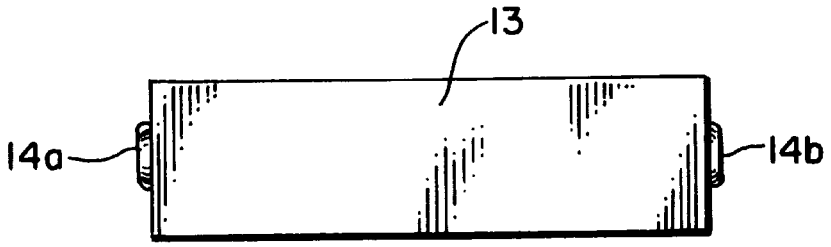
FIG. 3 is a top view of the shoe tongue positioner of the present invention.

FIG. 3 is a top view of upper body 10 of the present invention which depicts upper surface 13 and lateral attachment snaps 14*a* and 14*b*.

Figure 4:
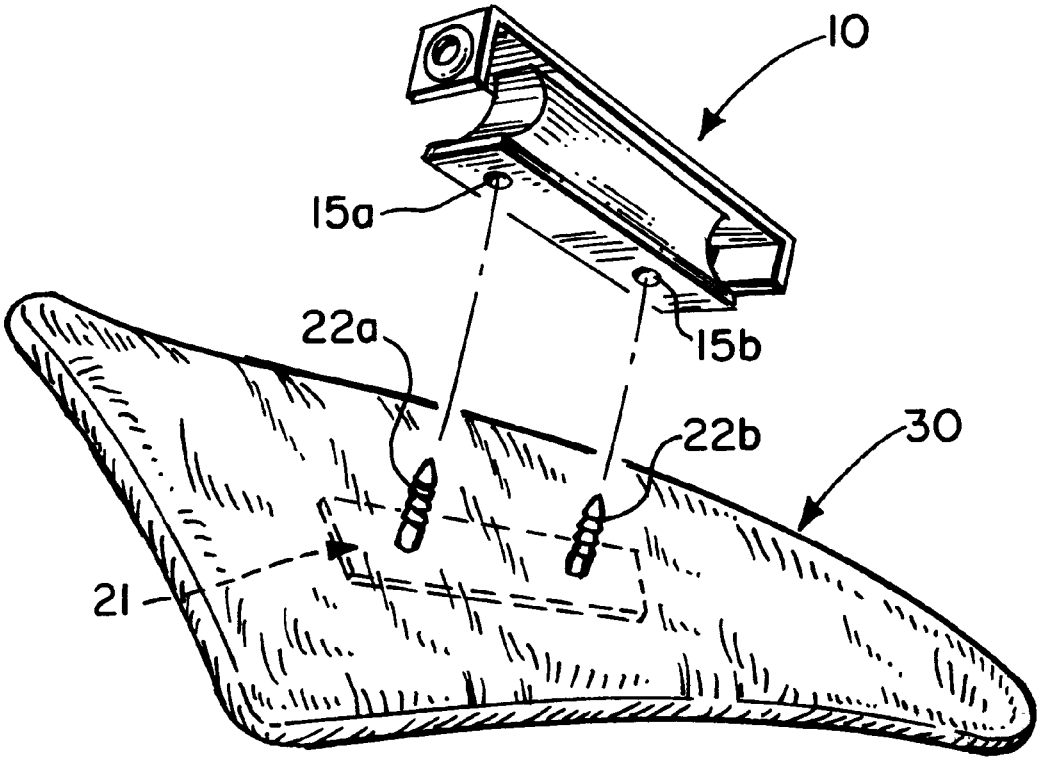
FIG. 4 is an exploded, schematic, perspective view of the shoe tongue positioner of the present invention.

FIG. 4 depicts tongue 30 of a standard lace-type shoe. Tacks 22*a* and 22*b* are used to puncture tongue 30 and penetrate therethrough. Generally flat base member 21, depicted in outline in FIG. 4, is positioned against the lower surface of shoe tongue 30. Upper body 10 is received on upper surface of shoe tongue 30, while tacks 22*a* and 22*b* are received within bores 15*a* and 15*b*, respectively, of upper body 10, and act to secure upper member 10 in a stationary position.

Figure 5:
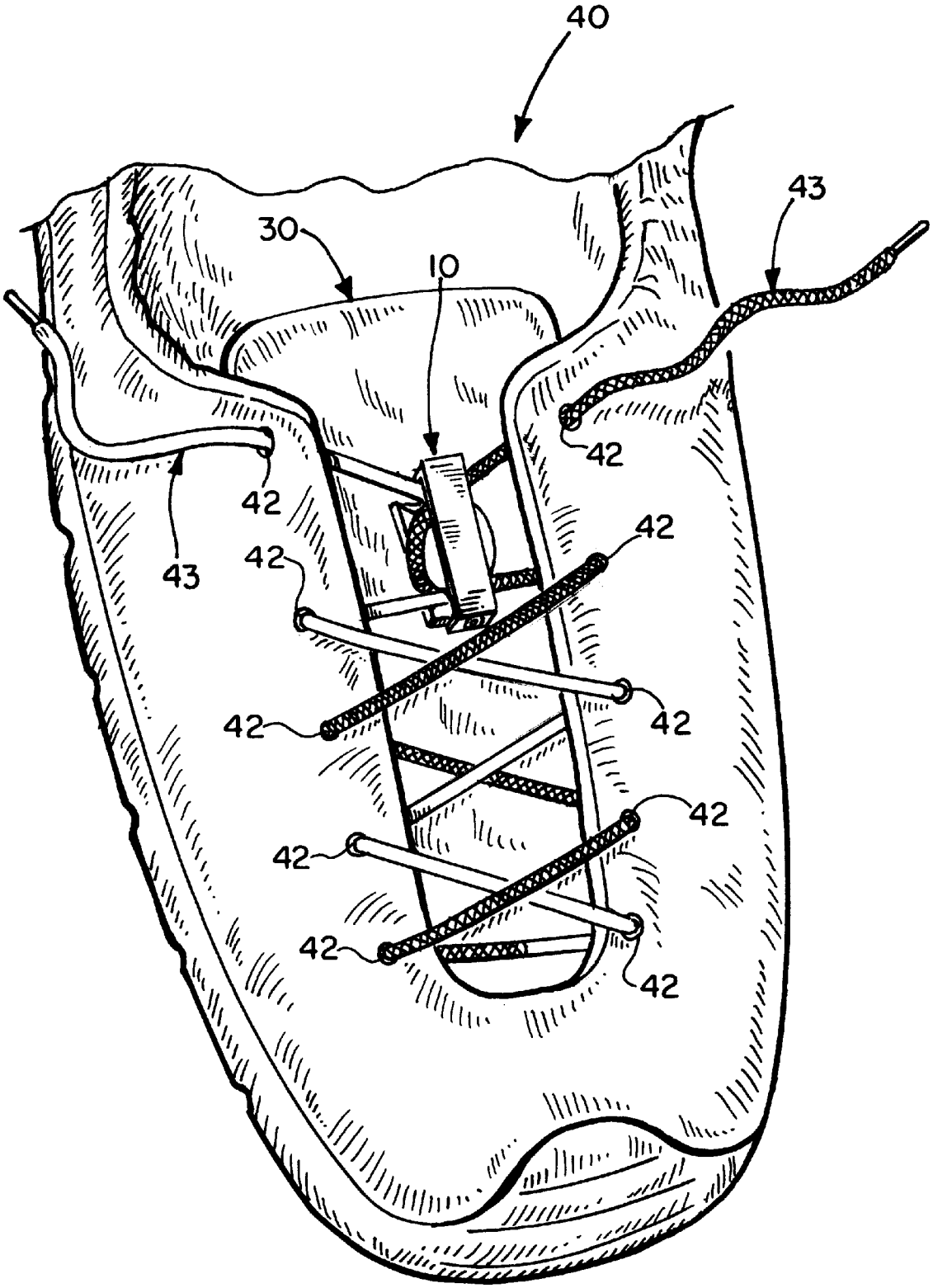
FIG. 5 is a perspective illustration of a shoe including the shoe tongue positioner according to the preferred form of the invention.

FIG. 5 depicts the shoe tongue positioner of the present invention being utilized in connection with a standard lace-type shoe 40. Lace 41, which is depicted in two-color format for clarity purposes, is threaded through eyelets 42 of shoe 40 in standard fashion. Upper body 10 is affixed to the upper surface of shoe tongue 30. Although not shown on FIG. 5, tacks 22*a* and 22*b* penetrate tongue 30 and are received within bores 15*a* and 15*b* of upper body 10 to secure upper body 10 to the upper surface of tongue 30. Although shoe tongue positioner of the present invention is not required to be affixed to a specific portion of tongue 30, it is generally considered preferable to affix said shoe tongue attachment as far from the toe of shoe as possible, while remaining below the uppermost pair of eyelets of shoe 40.

Still referring to FIG. 5, shoelace 43 is laced through eyelets 42 of shoe 40. Upon reaching the shoe tongue positioner of the present invention, shoe lace 43 is looped around upright central member 11 of upper body 10. As can be seen from FIG. 5 shoelace 43 is laced through an eyelet on one side of shoe 40, looped around upright central member 11, then laced through an eyelet on the same side of shoe 40. Similarly, the same lacing pattern is followed for the opposite side of shoe 40.

When shoelace 43 is tightened and tied, opposing forces are imparted on upright central member 11 by shoelace 43. Further, said opposing forces are also imparted on shoe tongue 30. As a result, these forces act to hold tongue 30 in a stationary position.

Figure 6:
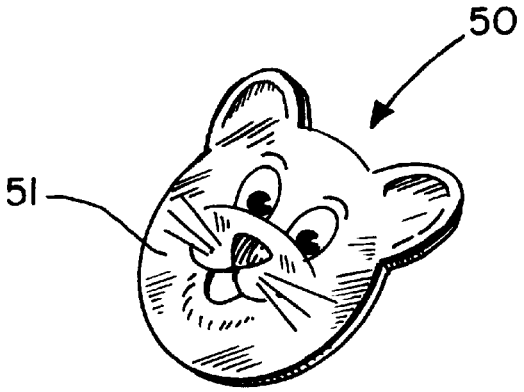
FIG. 6 is a front perspective view of a decorative emblem of the present invention.
Figure 7:
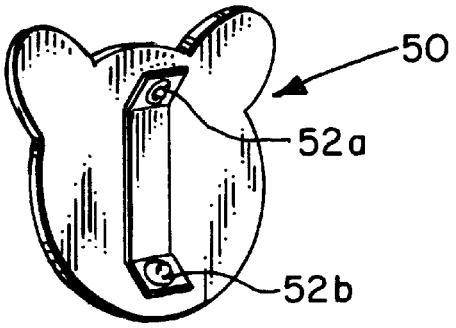
FIG. 7 is a rear perspective view of a decorative emblem of the present invention.

FIG. 6 and FIG. 7 depict emblem member 50 of the present invention. Display face 51 of emblem member 50 contains an ornamental design. While FIG. 6 and FIG. 7 depict a children's character face, it is envisioned that display face 51 could be a product logo, insignia or other ornamental design or inscription. FIG. 7 depicts snaps 52*a* and 52*b*, which can be used to affix emblem member 50 to upper so member 10 of the present invention.

Figure 8:
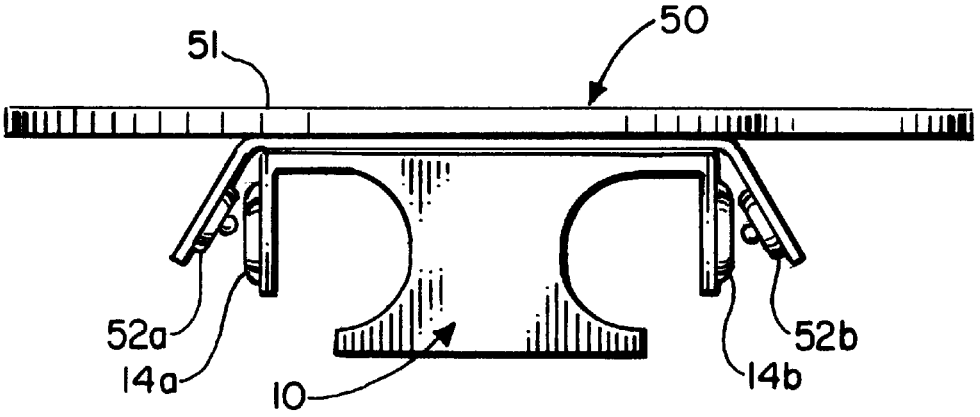
FIG. 8 is a side exploded view of the shoe tongue positioner and decorative emblem of the present invention.

FIG. 8 shows emblem member 50 mounted on upper body 10. Snaps 52*a* and 52*b* join with mating snaps 14*a* and 14*b* on the lateral ends of upper body 10. As can be seen from FIG. 8, emblem member 50 can be quickly and easily removed and replaced with a different emblem member, if desired.

Figure 9:
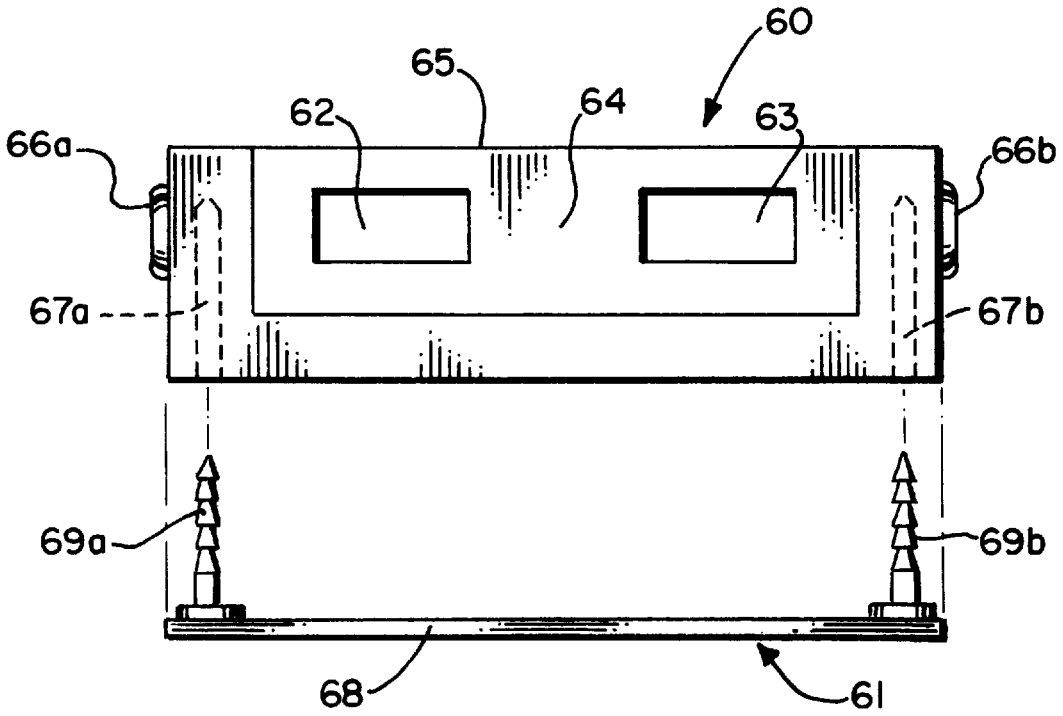
FIG. 9 is a side view of an alternative embodiment of the shoe tongue positioner of the present invention.

FIG. 9 depicts an alternative embodiment of the shoe tongue positioner of the present invention. The shoe tongue positioner depicted in FIG. 9 comprises upper body 60 and lower body 61. Upper body 60 has parallel apertures 62 and 63, which define rigid central member 64. Upper body 60 further comprises upper surface 65, as well as lateral attachment snaps 66*a* and 66*b*. Bores 67*a* and 67*b* extend from the base of upper body 60 into said body.

Lower body 61 comprises generally flat base member 68, as well as fastening tacks 69*a* and 69*b*. Fastening tacks 69*a* and 69*b* can be received within bores 67*a* and 67*b*, respectively, of upper body 60. Generally flat base member 68 should be of minimal thickness, yet should be sufficient to provide support for tacks 69*a* and 69*b*.

The alternative embodiment of the shoe tongue positioner depicted in FIG. 9 is used in much the same way as other embodiments of the invention depicted herein. Specifically, fastening tacks 69*a* and 69*b* puncture a shoe tongue and penetrate there through, allowing flat base member 68 to be positioned flush against the lower surface of the shoe tongue. Upper body 60 is positioned on the upper surface of said shoe tongue, and secured in place by fastening tacks 69*a* and 69*b*, which are received within bores 67*a* and 67*b*.

Once upper body 60 is secured to the upper surface of a shoe tongue, a shoelace can be threaded through said upper body to secure said shoe tongue n a stationary position. Specifically, a shoelace, which is threaded in a standard lace-type shoe, passes from one side of said shoe through aperture 62, around rigid central member 64, back through aperture 63, such that said shoelace is threaded back into the same side of said shoe from which it originated. Similarly, said lace is also passed through the present invention from the other direction. Such a threading pattern will result in opposing forces being imparted upon the shoe tongue positioner of the present invention, as well as the attached shoe tongue, thereby resulting in the shoe tongue being maintained in a stationary position. Additionally, upper surface 65 provides a surface or platform for the mounting or display of an ornamental emblem, company logo, insignia or other design, which can be affixed to upper body 60 by lateral attachment snaps 66*a* and 66*b*.

Whereas the invention disclosed herein is described with respect to a preferred embodiment, it should be realized that various changes or modifications may be made which do not depart from essential contribution to the art made by the teachings hereof.

What is claimed is:

1. An apparatus for securing a shoe tongue of a lace-type shoe in a stationary position comprising:

a. an upright rigid member having an upper surface and a lower surface;

b. one or more tacks;

c. one or more bores extending from the lower surface of said upright rigid member into said upright rigid member, wherein said bores are adapted to receive said tacks; and d. a generally planar member having an upper face and a lower face, wherein the base of said tacks are affixed to the upper face of said planar member.

2. The apparatus recited in claim 1, further comprising means for attaching an ornamental display to the upper surface of said upright rigid member.

3. The apparatus recited in claim 2 wherein said means for attaching an ornamental display to the upper surface of said upright rigid member is a separable fastener of a hook and loop type.

4. The apparatus recited in claim 2 wherein said means for attaching an ornamental display to the upper surface of said upright rigid member comprises one or more snaps.

5. An apparatus for securing a shoe tongue of a lace-type shoe in a stationary position comprising:

a. a roughly rectangular rigid member;

b. one or more tacks;

c. one or more bores extending from the lower surface of said roughly rectangular rigid member into said roughly rectangular rigid member, wherein said bores are aligned along the longitudinal axis of said roughly rectangular rigid member and adapted to receive said tacks; and d. a generally planar member having an upper face and a lower face, wherein the base of said tacks are affixed to the upper face of said planar member.

6. The apparatus recited in claim 5, further comprising means for attaching an ornamental display to the upper surface of said roughly rectangular rigid member.

7. The apparatus recited in claim 6 herein said means for attaching an ornamental display to the upper surface of said roughly rectangular rigid member is a separable fastener of a hook and loop type.

8. The apparatus recited in claim 6 wherein said means for attaching an ornamental display to the upper surface of said roughly rectangular rigid member comprises one or more snaps.

9. An apparatus for securing a shoe tongue of a lace-type shoe in a stationary position comprising:

a. a roughly rectangular rigid member having an enlarged surface area at its upper end, and inwardly concave surfaces at its short ends;

b. one or more tacks;

c. one or more bores extending from the lower surface of said roughly rectangular rigid member into said roughly rectangular rigid member, wherein said bores are aligned along the longitudinal axis of said roughly rectangular rigid member and adapted to receive said tacks; and d. a generally planar member having an upper face and a lower face, wherein the base of said tacks are affixed to the upper face of said planar member.

10. The apparatus recited in claim 9, further comprising means for attaching an ornamental display to the upper surface of said roughly rectangular rigid member.

11. The apparatus recited in claim 10 wherein said means for attaching an ornamental display to the upper surface of said roughly rectangular rigid member is a separable fastener of a hook and loop type.

12. The apparatus recited in claim 10 herein said means for attaching an ornamental display to the upper surface of said roughly rectangular rigid member comprises one or more snaps.

13. An apparatus for securing a shoe tongue of a lace-type shoe in a stationary position comprising:

a. an elongated rigid member having a plurality of apertures extending through said elongated rigid member, wherein the longitudinal axis of said elongated rigid member is parallel to the longitudinal axis of a shoe tongue, and said apertures are oriented perpendicular to the longitudinal axis of said elongated rigid member, b. one or more tacks;

c. one or more bores extending from the lower surface of said elongated rigid member into said elongated rigid member, wherein said bores are adapted to receive said tacks; and d. a generally planar member having an upper face and a lower face, wherein the base of said tacks are affixed to the upper face of said planar member.

14. The apparatus recited in claim 13, further comprising means for attaching an ornamental display to the upper surface of said elongated rigid member.

15. The apparatus recited in claim 14 wherein said means for attaching an ornamental display to the upper surface of said elongated rigid member is a separable fastener of a hook and loop type.

16. The apparatus recited in claim 14 wherein said means for attaching an ornamental display to the upper surface of said elongated rigid member comprises one or more snaps.

* * * * *